US007048625B2

(12) United States Patent
Anezaki et al.

(10) Patent No.: US 7,048,625 B2
(45) Date of Patent: May 23, 2006

(54) CLEAN BENCH FOR CLEANING ATMOSPHERE OF PARTITIONED SPACE

(75) Inventors: Yuichi Anezaki, Niigata-ken (JP); Teruo Igarashi, Niigata-ken (JP); Shigehito Seki, Niigata-ken (JP)

(73) Assignee: Alps Electric Co., Ltd, Tokyo (JP)

( * ) Notice: Subject to any disclaimer, the term of this patent is extended or adjusted under 35 U.S.C. 154(b) by 57 days.

(21) Appl. No.: 10/895,496

(22) Filed: Jul. 21, 2004

(65) Prior Publication Data

US 2005/0048899 A1 Mar. 3, 2005

(30) Foreign Application Priority Data

Jul. 29, 2003 (JP) ..... 2003-203014
Jul. 29, 2003 (JP) ..... 2003-203015

(51) Int. Cl.
*B08B 15/12* (2006.01)

(52) U.S. Cl. ..... 454/57; 454/56; 454/60

(58) Field of Classification Search ..... 454/56, 454/57, 58, 60

See application file for complete search history.

(56) References Cited

U.S. PATENT DOCUMENTS 3,944,405 A * 3/1976 VAN Calsteren et al. .... 55/338
4,098,174 A * 7/1978 Landy ..... 454/57
4,100,847 A * 7/1978 Norton ..... 454/57
4,249,463 A * 2/1981 Hornby ..... 454/57
4,557,184 A 12/1985 Orii et al.
4,637,301 A * 1/1987 Shields ..... 454/57

FOREIGN PATENT DOCUMENTS

EP 43 05 208 A * 8/1994
JP 2001-141273 5/2001

* cited by examiner

*Primary Examiner*—Harold Joyce
(74) *Attorney, Agent, or Firm*—Brinks Hofer Gilson & Lione

(57) ABSTRACT

A substantially cubic work space extends from an upper opening to the interior of a housing. A substantially cubic lower space extends from a lower opening to the interior of the housing. A front cover covering the upper opening is provided on the front of the work space. The front cover is, for example, a transparent resin sheet bent and protruding from the upper opening to the interior of the work space, and is held, by a horizontal rod, in the form of the letter L in cross-section. A clean bench having a simple structure, easily installed, and being capable of achieving a high level of cleanliness even if installed in a relatively unclean environment can thus be provided.

10 Claims, 5 Drawing Sheets

CLEAN BENCH FOR CLEANING ATMOSPHERE OF PARTITIONED SPACE

This application claims the benefit of priority to Japanese Patent Application Nos. 2003-203014 and 2003-203015, herein incorporated by reference.

BACKGROUND OF THE INVENTION

1. Field of the Invention

The present invention relates to a clean bench for maintaining a clean atmosphere in a partitioned space.

2. Description of the Related Art

For example, in a clean room for manufacturing semiconductors, a high level of cleanliness is maintained by supplying air containing a very small amount of dust through a vent, the air being purified by an air purifier having a high efficiency particulate air (HEPA) filter. Construction of such a clean room involves extensive work including designing and installing filtering units and ducts in the entire building and each segment of a partitioned floor.

A clean bench, which is installed in a normal room environment and used, is known as an example of means for easily maintaining a clean atmosphere in a confined space without requiring extensive construction work. Such a clean bench measuring, for example, about 1 m wide by 2 m high has a clean unit including a dust-removing filter and supplies filtered air into a clean area of the clean bench to maintain cleanliness only in the clean area (see, for example, Japanese Unexamined Patent Application Publication No. 2001-141273).

However, cleanliness in the clean area of the clean bench described above cannot reach a satisfactory level unless the clean bench is installed in an environment with a certain level of cleanliness. For example, when a known clean bench is installed and used in a misty environment, such as a manufacturing site, a predetermined cleanliness level of a clean area is not necessarily reached.

SUMMARY OF THE INVENTION

The present invention is made in view of the circumstances described above and aims to provide a clean bench having a simple structure, easily installed, and being capable of achieving a high level of cleanliness even if installed in a relatively unclean environment.

To achieve the above-described object, a clean bench of the present invention includes a housing having a work space in the center, the work space being filled with a filtered atmosphere; a filtering unit disposed on top of the work space and blowing filtered air into the work space; a front cover located on the front of the work space and covering the front of the work space while leaving a certain gap in the lower part of the work space; a flow-regulating space under the work space and into which the air from the work space flows; a circulation duct connecting the flow-regulating space with the filtering unit for allowing the air in the flow-regulating space to circulate; and an intake for drawing outside air into the flow-regulating space and the circulation duct.

This clean bench has a simple structure, yet can maintain a high level of cleanliness in the work space. Moreover, the clean bench can provide a very high degree of workability since a high level of cleanliness in the work space can be maintained even if a certain gap is left at the lower part of the work space.

The filtering unit may include a main filter and a first auxiliary filter. This increases the air permeability and life of the main filter. The lower edge of an opening on the front of the work space may be provided with a canopy protruding obliquely downward from the front of the housing. This canopy limits the entry of outside air from the gap at the lower part on the front of the work space, thereby contributing to maintaining the cleanliness of the work space.

The clean bench may further include a light-transmitting back plate disposed on the back of the work space, and a light at the rear face of the back plate, the work space being illuminated with the light through the back plate. This light prevents turbulence of clean air that occurs when the light is disposed in the work space, and thereby contributing to maintaining the cleanliness of the work space. Even if the light is covered with dust, the cleanliness of the work space can be well maintained by the back plate isolating the light from the work space.

The intake may be provided with a second auxiliary filter. The second auxiliary filter can prevent a direct entry of outside air containing a large amount of dust into the clean bench, and thereby increasing the life as well as air permeability of the first auxiliary filter in the filtering unit.

One or more flow regulators may extend downward from the bottom of the work space in the flow-regulating space. It is preferable that the width of a segment of the flow-regulating space partitioned by the flow regulator is substantially the same as the width of the circulation duct. The flow regulator regulates the flow of clean air from a top plate through the work space, and thereby interfering with the inflow of outside air from the gap in the lower part of the work space.

The present invention provides a clean bench including a housing having a work space in the center, the work space being filled with a filtered atmosphere; a filtering unit disposed on top of the work space and blowing filtered air into the work space; a front cover located on the front of the work space and covering the front of the work space while leaving a certain gap in the lower part of the work space and being bent toward the work space in the center; a flow-regulating space defined in the lower part of the work space and into which the air of the work space flows; a circulation duct connecting the flow-regulating space with the filtering unit for allowing the air in the flow-regulating space to circulate; and an intake for drawing outside air into the flow-regulating space and the circulation duct.

This clean bench has a simple structure, yet can maintain a high level of cleanliness in the work space. Moreover, the clean bench can provide a very high degree of workability since a high level of cleanliness in the work space can be maintained even if a certain gap is left at the lower part of the work space. Since the center of the front cover covering the front of the work space is bent toward the interior of the work space, the velocity of the clean airflow momentarily increases and the clean airflow along the bend is led to an opening at the lower part of the work space. This limits the entry of outside air from the opening. Moreover, since the front cover has the bend, an operator who works at the clean bench can look down over the entire work space through the bend. Thus, the operator can easily observe the work space and efficiently conduct work.

A skirt capable of adjusting the distance of the gap may be provided at the bottom end of the front cover. The skirt can adjust the distance of the gap, thereby not only allowing the operator for the clean bench to insert his/her arms into the work space, but also minimizing the distance of the gap during work to limit the entry of outside air into the work space. If the skirt is made of flexible material, the operator can insert only his/her arms into the work space to conduct work while the gap closes.

A lower edge of the opening on the front of the work space may be provided with a canopy protruding obliquely downward from the front of the housing. This canopy creates an outflow of air from the gap to prevent the entry of a large amount of outside air from the gap, thereby maintaining the cleanliness of the work space.

A lower space isolated from the flow-regulating space and being open on the front may preferably be provided in front of the flow-regulating space. This lower space accommodates the legs of the operator sitting in front of the clean bench for conducting work, and thereby improving the ease of work for the operator.

DESCRIPTION OF THE PREFERRED EMBODIMENTS

Figure 1:
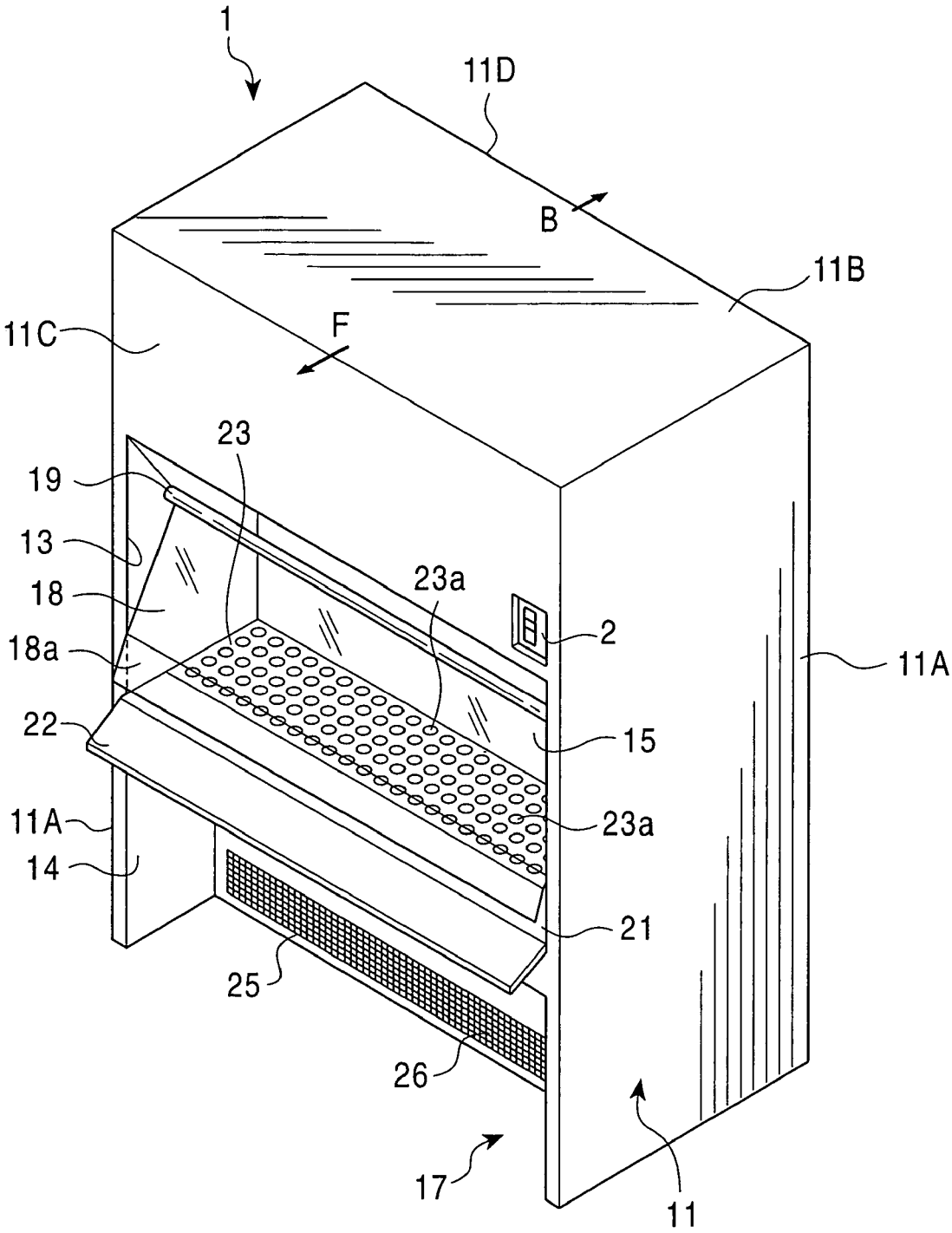
FIG. 1 is an external perspective view of a clean bench according to the present invention.
Figure 2:
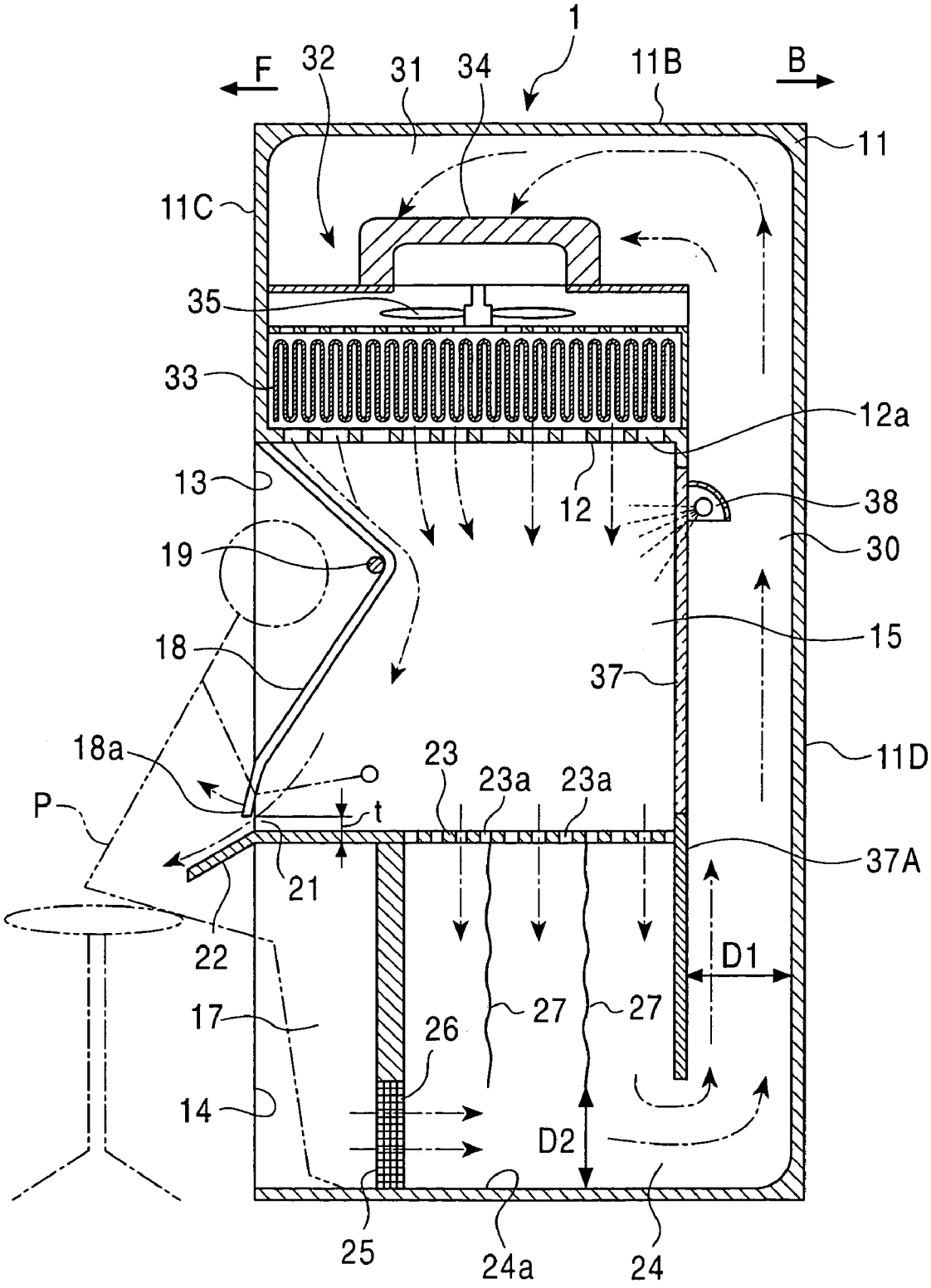
FIG. 2 is a cross-sectional view of the clean bench in FIG. 1.

Embodiments of the present invention will now be described with reference to the drawings. FIG. 1 is an external perspective view of a clean bench according to the present invention. FIG. 2 is a cross-sectional view of the clean bench in FIG. 1. A clean bench 1 has a resin or metal housing 11 measuring, for example, about 1 m wide by 2 m high. The housing 11 is shaped like a box with side walls 11A and 11A at both sides, a ceiling board 11B, a front wall 11C leading to the upper front of the side walls 11A and 11A as well as to the ceiling board 11B, and a back board 11D. The housing 11 is provided with an opening 13 in the middle of a front side F and a lower opening 14 under the opening 13. A switch plate 2 including a main switch of the clean bench 1 is provided above the opening 13 of the housing 11.

A substantially cubic work space 15 extends from the opening 13 to the interior of the housing 11. A substantially cubic lower space 17 extends from the lower opening 14 to the interior of the housing 11. A front cover 18 covering the opening 13 is provided on the front of the work space 15. The front cover 18 is, for example, a transparent resin sheet or resin panel, protrudes from the opening 13 toward the interior of the work space 15, and is kept in the form of the letter L in cross-section by a horizontal rod 19. The front cover 18 may be, for example, a hard glass plate protruding from the opening 13 toward the interior of the work space 15 without being held by the horizontal rod 19.

A gap 21 of a certain distance is created between the lower end of the front cover 18 and the lower end of the opening 13. The gap 21 allows air to circulate between the work space 15 and the outside. A skirt 18*a* capable of adjusting the distance of the gap 21 is provided at the lower end of the front cover 18. Raising of the skirt 18*a* to increase the distance of the gap 21 not only enables an operator P for the clean bench 1 to insert his/her arms into the work space 15, but also minimizes the height of the gap 21 during work.

A lower edge of the opening 13 is provided with a canopy 22 protruding obliquely downward from the front side of the housing 11. The canopy 22 regulates the outflow of air from the gap 21. This prevents the generation of turbulent airflow in the vicinity of the gap 21 and limits the entry of outside air from the gap 21.

A ventilation plate 23, which is, for example, a metal plate or a punched metal plate and has many vents 23*a*, is disposed at the bottom of the work space 15. A flow-regulating space 24 is provided under the ventilation plate 23. The ventilation plate 23 serves as a bottom plate for mounting various bases and devices in the work space 15 while allowing air to circulate between the work space 15 and the flow-regulating space 24. The ventilation plate 23 is recessed from the gap 21 of the work space 15 toward a back side B of the housing 11. Since the ventilation plate 23 is distant from the gap 21, a direct entry of a large amount of outside air from the gap 21 through the ventilation plate 23 toward the flow-regulating space 24 can be prevented.

The lower space 17, for example, accommodates the legs of the operator P sitting in front of the clean bench 1 during work to improve the ease of work for the operator P. An intake 25 facing the flow-regulating space 24 is provided on the back of the lower space 17 and below the work space 15. Since air flows down from the gap 21 of the work space 15, the air outside the intake 25 is cleaner than normal outside air. Therefore, the amount of dust drawn into the flow-regulating space 24 is limited.

A second auxiliary filter 26 is attached to the intake 25. The second auxiliary filter 26 traps dust particles with relatively large diameters in outside air and allows the air with a certain level of cleanliness to flow into the flow-regulating space 24. Since the outside air from which relatively large particles of dust are removed is taken into the flow-regulating space 24, the life as well as the air permeability of a first auxiliary filter 34 in a filtering unit 32 (described below) increase. For example, a filter of 300 mesh or above, specifically, a filter of 300 to 600 mesh may be laminated to form the second auxiliary filter 26 so as to prevent the entry of large dust particles having diameters of 5 μm or above. Although the intake 25 facing the flow-regulating space 24 is provided in the present embodiment, the intake 25 may be formed in the back board 11D or the ceiling board 11B to face the circulation duct 30.

At least one flow regulator 27 hangs down from the bottom of the ventilation plate 23 in the flow-regulating space 24. The flow regulator 27 may be, for example, a rubber plate, a resin plate, or a resin film and one or more flow regulators 27 may be provided.

A filtering space 31 is provided above a top plate 12, which is disposed on top of the work space 15. The top plate 12 partitioning the work space 15 and the filtering space 31 has many vents 12*a* and allows air to circulate between the work space 15 and the filtering space 31.

The circulation duct 30 that allows air to circulate between the filtering space 31 and the flow-regulating space 24 is provided on the back side B of the housing 11. The circulation duct 30 is surrounded by the back board 11D, the side walls 11A and 11A, and the ceiling board 11B of the housing 11 and a back plate 37 of the work space 15. This structure determines the airflow channel from the filtering space 31, through the work space 15, the flow-regulating space 24, the circulation duct 30, and back to the filtering space 31. Preferably, the circulation duct 30 has, for example, a depth D1 that is substantially the same as the distance D2 between a bottom end of the flow regulator 27 and a bottom surface 24*a* of the flow-regulating space 24. When D1 and D2 are substantially the same, air flows at a substantially uniform speed and the circulation of air is stabilized.

The filtering space 31 is provided with the filtering unit 32 disposed over the many vents 12*a* of the top plate 12 and firmly attached to the top plate 12 with, for example, rubber packing.

The filtering unit 32 includes a main filter 33, the first auxiliary filter 34, and a fan 35. The first auxiliary filter 34 traps dust particles with relatively large diameters for allowing the air with a certain level of cleanliness to flow into the main filter 33. The first auxiliary filter 34, for example, reduces the number of dust particles per cubic foot of air from about 50,000 to 9,000. The first auxiliary filter 34 serves as a prefilter that traps dust particles with relatively large diameters, and thereby reduces clogging in the main filter 33 and thus can extend the life of the main filter 33.

The main filter 33 is preferably, for example, a HEPA filter, which is a paper-like filter primarily made of glass wool. To enhance the effectiveness of dust collection, the HEPA filter with a large surface area is folded and stored. The HEPA filter can trap extremely fine dust particles having diameters of 1 μm or less by using three filter properties, that is, inertia, diffusion, and collision.

The fan 35 pulls in the air of the filtering space 31 through the first auxiliary filter 34 and sends the air to the main filter 33. Then, clean air containing, for example, 10 or less fine dust particles per cubic foot is supplied from the bottom of the filtering unit 32 through the top plate 12 into the work space 15. Thus, the work space 15 meeting Class 10, which is a standard of cleanliness, is maintained. The main filter 33 is not limited to a HEPA filter but may be replaced with another filter, such as an ultra low particulate air (ULPA) filter, that exhibits higher performance in removing dust particles.

The back plate 37 partitioning the work space 15 and the circulation duct 30 is disposed on the back side B of the work space 15. The back plate 37 is, for example, a transparent resin plate. A light 38 is attached to a portion of the circulation duct 30, the portion adjacent to an upper portion of the work space 15. A partition 37A is attached to the lower end of the back plate 37 and suspended downward from the bottom of the work space 15. The lower ends of the partition 37A and the flow regulator 27 (described below) are positioned at substantially the same level.

The work space 15 is illuminated with the light 38 through the back plate 37, which is a transparent resin plate. Turbulence of clean air and the entry of dust that occur when a light is disposed in the work space 15 can be prevented by disposing the light 38 in the circulation duct 30 such that the work space 15 is illuminated through the back plate 37.

The flow of air and effects of the clean bench 1 structured above will now be described in detail. The air in the filtering space 31 is pulled by the rotation of the fan 35 into the filtering unit 32 through the first auxiliary filter 34, which removes dust and reduces the number of dust particles per cubic foot to about 9,000. The air passed through the first auxiliary filter 34 is led to the main filter 33, which reduces the number of dust particles per cubic foot to about 10.

Thus, the extremely clean air, in which the number of dust particles per cubic foot is reduced to about 10, is supplied from the filtering unit 32 through the top plate 12 into the work space 15. A flow of clean air from the top plate 12 to the ventilation plate 23 is formed in the work space 15, which thus maintains the atmosphere meeting Class 10 cleanliness that permits very limited amount of dust. Class 10 atmosphere of the work space 15 cannot be achieved immediately after starting operation of the clean bench 1, but can be achieved after circulation of air and removal of dust for a certain period of time. Once achieved, Class 10 cleanliness of the work space 15 can be maintained as long as circulation of air and removal of dust are continuously performed. In a normal environment where outside air contains many particles having, for example, diameters of 0.5 μm, ventilation is preferably performed many times. For example, performing ventilation 600 or more times per hour, and preferably 1,000 or more times per hour is effective for maintaining cleanliness.

Since the front cover 18 covering the opening 13 of the work space 15 is bent toward the interior of the work space 15 and kept in the form of the letter L in cross-section, the operator P who works at the clean bench 1 can look down over the entire work space 15 through the bend of the front cover 18. Thus, the operator P can easily observe the work space 15 and efficiently conduct work.

The velocity of a clean airflow from the top plate 12 momentarily increases at the bend of the front cover 18 because of the increase in surface density. The clean air flows along the top of the bend, goes down to the lower part of the opening 13 of the work space 15, and thereby limits the entry of outside air from the opening 13. The bend of the front cover 18 is shaped to optimize the clean airflow according to the work space 15, so that the cleanliness in the work space 15 can be well maintained. The canopy 22 protruding obliquely downward from the lower end of the opening 13 regulates the outflow of air from the gap 21 so as to prevent turbulence caused by the outflow of air from the gap 21. The entry of outside air from the gap 21 caused by turbulence can thus be limited.

As described above, even though the gap 21 is created by the bent front cover 18 and the canopy 22 for the operator P to conduct work in the work space 15, an extremely clean atmosphere in the work space 15 can be maintained. Moreover, since the ventilation plate 23 is recessed from the gap 21 of the work space 15 toward the back side B, a reduction in cleanliness of the work space 15, which is caused by a direct entry of a large amount of outside air from the gap 21 through the ventilation plate 23 to the flow-regulating space 24, can be prevented.

The air in the work space 15 is guided through the ventilation plate 23 to the flow-regulating space 24. The air introduced into the flow-regulating space 24 flows downward along the flow regulators 27 to the vicinity of the bottom of the flow-regulating space 24, and then circulates through the circulation duct 30 to the filtering space 31. Since the flow regulators 27 allow the air from the work space 15 to flow down to the vicinity of the bottom of the flow-regulating space 24, an airflow for guiding the outside air, which has been filtered through the second auxiliary filter 26, into the lower side of the flow-regulating space 24 can be generated.

Although a certain amount of outside air may enter through the gap 21 of the work space 15, the cleanliness of the work space 15 can be efficiently improved by allowing the incoming outside air to flow downward temporarily to the vicinity of the bottom of the flow-regulating space 24. Moreover, when the distance D2 between the lower end of the flow regulator 27 and the bottom of the flow-regulating space 24, and the diameter D1 of the circulation duct 30 are the same, the air from the work space 15 along the flow regulators 27 and the outside air entering from the intake 25 through the second auxiliary filter 26 are sent into the circulation duct 30 at the same velocity. This stabilizes the air circulation in the clean bench 1.

The air from the flow-regulating space 24 flows through the circulation duct 30 and is introduced into the filtering space 31 again. The clean bench 1 circulates most of the air therein while taking in a proper amount of outside air. Thus, extremely high cleanliness in the work space 15 can be achieved in a short time by operating the filtering unit 32.

EXAMPLES

The present applicant has tested the functions of the clean bench structured as described above. For the test, a clean bench having the same structure as that of the above-described embodiment was prepared. To test the purifying performance of the clean bench according to the present invention, the number of dust particles in the outside air was measured with a particle counter. The result showed that 20,000 to 25,000 dust particles having an average diameter of 0.5 μm were contained in a cubic foot of air.

Figure 3:
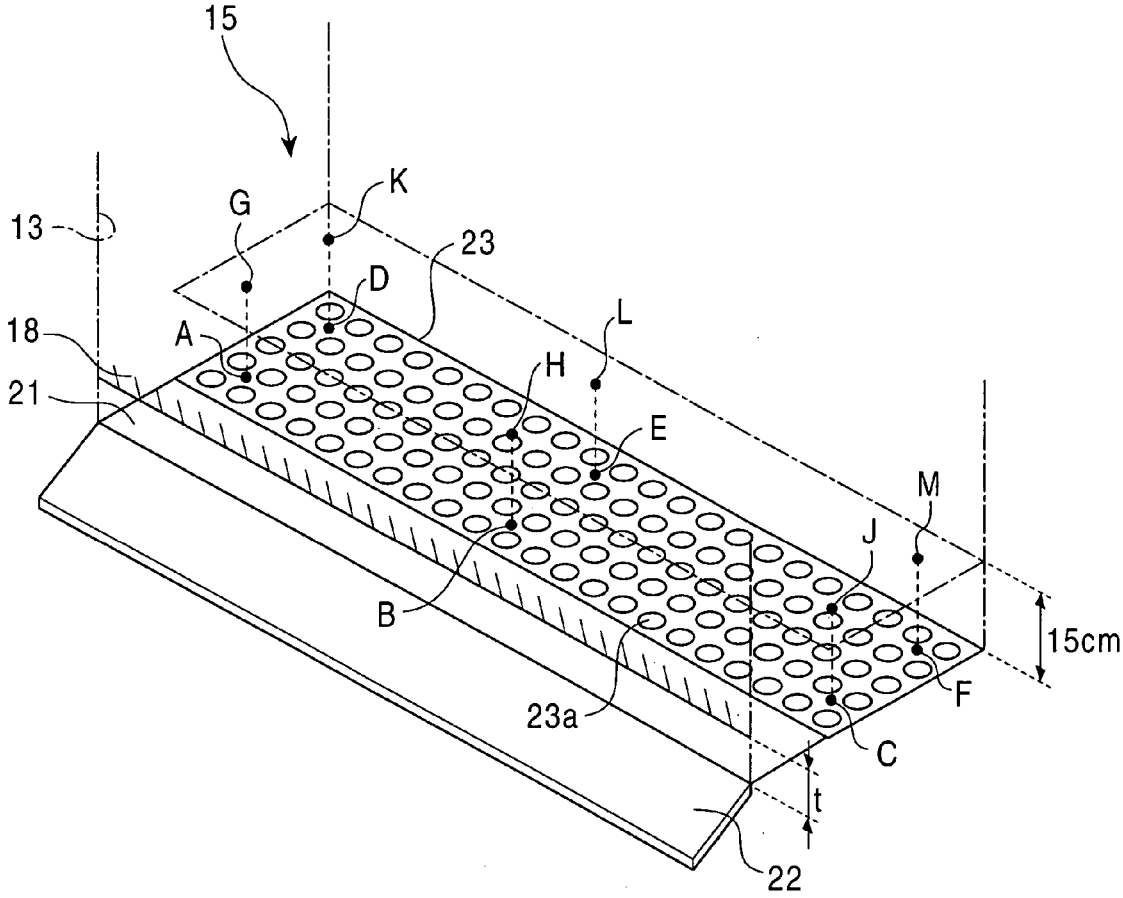
FIG. 3 shows points of measurement for testing of the present invention.

Subsequently, as shown in FIG. 3, 12 measuring points A to M were provided in the work space 15 of the clean bench 1 to count the number of dust particles at each measuring point using the particle counter. The size of the clean bench 1 used for the test was 2.0 m in height, 1.3 m in width, and 0.8 m in depth, while the size of the work space 15 was 0.6 m in height, 1.2 m in width, and 0.5 m in depth. Two flow regulators 27 hung from the bottom of the work space 15 down to the flow-regulating space 24. The distance D1=D2 shown in FIG. 2 was 20 cm. The first auxiliary filter 34 in the filtering unit 32 was a 300-mesh filter, and the second auxiliary filter 26 was also a 300-mesh filter. The number of ventilation cycles per hour was 1,800 times.

The measuring points A and C on the ventilation plate 23 were located at 10 cm from the respective sides and 15 cm from the front end of the ventilation plate 23. The measuring points D and F on the ventilation plate 23 were located at 10 cm from their respective adjacent sides and 10 cm from the back end of the ventilation plate 23. The measuring point B on the ventilation plate 23 was located in the middle of the measuring points A and C, while the measuring point E on the ventilation plate 23 was located in the middle of the measuring points D and F. The measuring points G to M were located 25 cm above their respective corresponding measuring points A to F (that is, at a level 25 cm above the upper surface of the ventilation plate 23).

Then, the number of dust particles having an average diameter of 0.5 μm was measured with a particle counter at each of the measuring points A to M. Table 1 shows the result.

TABLE 1

| | |
|---|---|
| A | 0.30 |
| B | 0.29 |
| C | 0.00 |
| D | 0.00 |
| E | 0.00 |
| F | 0.00 |
| G | 0.00 |
| H | 0.00 |
| J | 0.00 |
| K | 0.00 |
| L | 0.00 |
| M | 0.00 |

According to Table 1 showing the number of dust particles counted at each of the measuring points A to M, the clean bench of the present invention achieves a very clean atmosphere that fully satisfies Class 10, which is a level of a standard for clean rooms, over the entire work space 15. It was thus proven that a very clean atmosphere could be achieved by a simple structure of the clean bench according to the present invention.

Subsequent measurement verified the relationship between the cleanliness of the work space 15 and the distance of the gap 21, which is made between the lower end of the front cover 18 and the lower end of the opening 13, in the clean bench according to the present invention. For the verification, a clean bench having the same structure as that of the above-described embodiment was prepared. The cleanliness of the work space 15 was measured at the measuring point B when the distance t of the gap 21 was 0, 15, 20, 23, and 33 cm. In the measurement, the number of dust particles (the number of particles per cubic foot of air: particles/1CF) having an average diameter of 0.5 μm was counted with a particle counter at the measuring point B at each of the above-described sizes of the gap 21.

Figure 4:
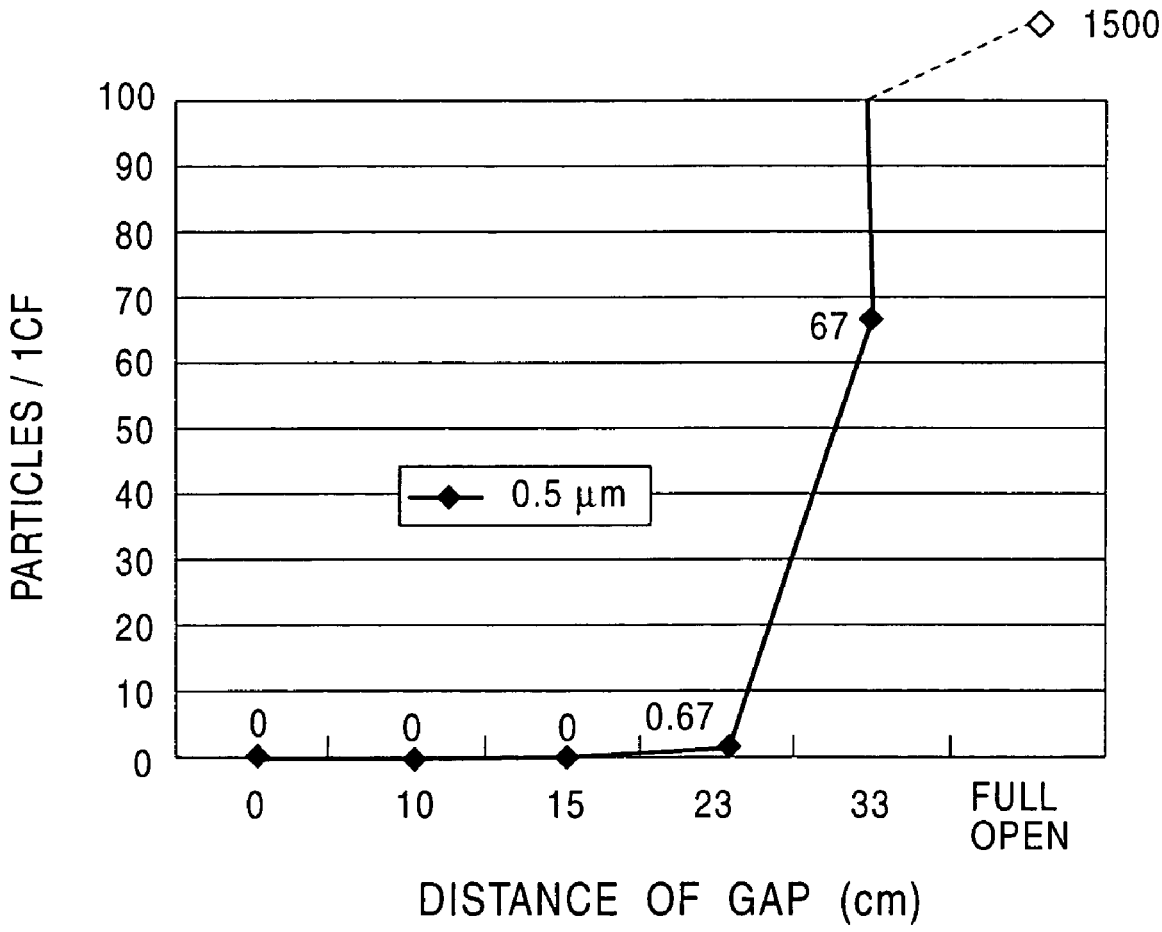
FIG. 4 is a graph showing a result of testing of the present invention.

FIG. 4 is a line graph showing the number of dust particles at each predetermined distance t of the gap 21. FIG. 4 shows that even if the gap 21 is increased to about 23 cm, the average number of dust particles is about 0.67 at most, and the work space 15 achieves a very clean atmosphere that satisfies Class 10, which is a level of a standard for clean rooms. It was proven that the gap 21 of 23 cm not only ensured very high-cleanliness of the clean bench, but also allowed the operator to insert his/her arms into the work space 15 to freely work, and thereby providing excellent operability.

The function of the flow regulators 27 (see FIG. 2) provided in the flow-regulating space 24 of the clean bench according to the present invention was also tested. For the test, a clean bench having the same structure as that of the above-described embodiment was prepared. The cleanliness of the work space 15 was measured at the measuring point B when the flow regulators 27 were attached to and removed from the clean bench.

Figure 5:
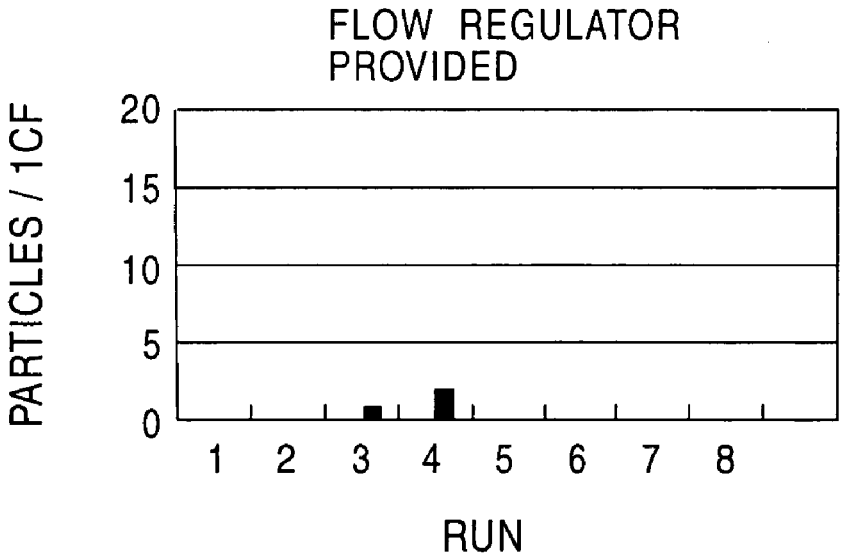
FIG. 5 is a graph showing a result of testing of the present invention.
Figure 6:
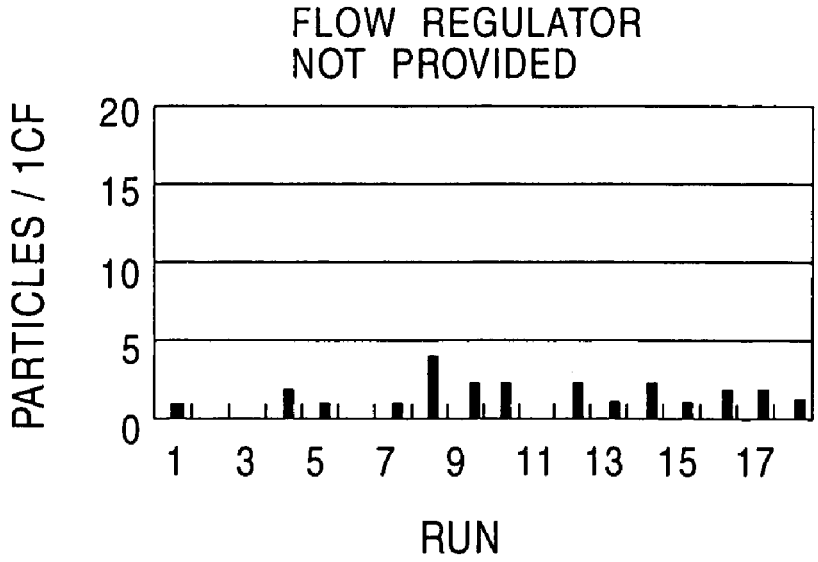
FIG. 6 is a graph showing a result of testing of the present invention.

Bar graphs in FIGS. 5 and 6 show the number of dust particles (the number of particles per cubic foot of air: particles/1CF) having an average diameter of 0.5 μm counted at the measuring point B when the flow regulators 27 are attached to and removed from the clean bench. FIGS. 5 and 6 show that the average number of dust particles in the work space 15 is obviously below 9 at a maximum when the flow regulators 27 are provided, and that a very clean atmosphere satisfying Class 10, which is a level of a standard for clean rooms, is achieved.

Even if no flow regulator 27 is provided, the average number of dust particles in the work space 15 is obviously below 9, which satisfies Class 10 standard. However, the frequency of detecting dust particles is higher compared to the case when the flow regulators 27 are provided. It was proven from the result that the flow regulators 27 of the clean bench according to the present invention were effective in improving cleanliness of the work space 15.

Although the front cover 18 is bent toward the interior of the work space 15 in the above-described embodiment, this may be replaced with a flat front cover covering the opening on the front of the work space. Although the first auxiliary filter 34 and the second auxiliary filter 26 serve as prefilters for the main filter 33 of the filtering unit 32 in the embodiment, the number and use of auxiliary filters may be determined depending on the filtering performance of each filter.

What is claimed is:

1. A clean bench comprising:

a housing having a work space in a center, the work space being filled with a filtered atmosphere;

a filtering unit disposed on top of the work space and blowing filtered air into the work space through a top plate;

a front cover located on a front of the work space and covering the front of the work space while leaving a certain gap in a lower part of the work space;

a flow-regulating space under the work space and into which the air from the work space flows through a ventilation plate;

a circulation duct connecting the flow-regulating space with the filtering unit for allowing the air in the flow-regulating space to circulate;

an intake for drawing outside air into the flow-regulating space and the circulation duct; and a flow regulator extending downward from the ventilation plate to direct the air from the work space to flow downward in the flow-regulating space.

2. The clean bench according to claim 1, wherein the filtering unit comprises a main filter and a first auxiliary filter disposed on the main filter.

3. The clean bench according to claim 1, wherein a lower edge of an opening on the front of the work space is provided with a canopy protruding obliquely downward from a front of the housing.

4. The clean bench according to claim 1, further comprising:

a light-transmitting back plate disposed on a back of the work space; and a light at a rear face of the back plate, the work space being illuminated with the light through the back plate.

5. The clean bench according to claim 1, wherein the intake is provided with a second auxiliary filter.

6. The clean bench according to claim 1, wherein a width of a segment of the flow-regulating space partitioned by the flow regulator is substantially the same as a width of the circulation duct.

7. A clean bench comprising:

a housing having a work space in a center, the work space being filled with a filtered atmosphere;

a filtering unit disposed on top of the work space and blowing filtered air into the work space;

a front cover located on a front of the work space and covering the front of the work space while leaving a certain gap in a lower part of the work space and being bent toward the work space in the center;

a flow-regulating space under the work space and into which the air from the work space flows;

a circulation duct connecting the flow-regulating space with the filtering unit for allowing the air in the flow-regulating space to circulate; and an intake for drawing outside air into the flow-regulating space and the circulation duct.

8. The clean bench according to claim 7, wherein the front cover has a bottom end provided with a skirt capable of adjusting a distance of the gap.

9. The clean bench according to claim 7, wherein a lower edge of an opening on the front of the work space is provided with a canopy protruding obliquely downward from the front of the housing.

10. The clean bench according to claim 7, wherein a lower space is provided in front of the flow-regulating space, the lower space being isolated from the flow-regulating space and being open on the front.

* * * * *